United States Patent [19]

Bottem

[11] Patent Number: 4,662,525

[45] Date of Patent: May 5, 1987

[54] LOGGING CARRIAGE WITH BAND BRAKE

[75] Inventor: Dennis J. Bottem, Eugene, Oreg.

[73] Assignee: Danebo Parts & Equipment, Inc., Eugene, Oreg.

[21] Appl. No.: 735,070

[22] Filed: May 17, 1985

[51] Int. Cl.[4] ..... B66C 21/00

[52] U.S. Cl. ..... 212/76; 188/77 R; 212/83; 212/89; 212/96; 212/98

[58] Field of Search ..... 212/71-121; 188/61.5, 82.3, 77 R, 77 W, 83

[56] References Cited

U.S. PATENT DOCUMENTS

| | | | |
|---|---|---|---|
| 3,531,000 | 9/1970 | Rennie et al. | 212/76 X |
| 3,907,075 | 9/1975 | Christison et al. | 188/77 W |
| 4,009,769 | 3/1977 | Nagatomo | 188/77 R |
| 4,164,289 | 8/1979 | Haliewicz | 212/76 X |
| 4,168,768 | 9/1979 | Johnson et al. | 188/77 R |
| 4,456,100 | 6/1984 | Manaki | 188/77 R |
| 4,515,281 | 5/1985 | Maki | 212/76 |

*Primary Examiner*—Joseph F. Peters, Jr.
*Assistant Examiner*—R. B. Johnson
*Attorney, Agent, or Firm*—Kolisch, Hartwell & Dickinson

[57] ABSTRACT

A novel log-hauling carriage which features a band brake assembly for controlling rotation of a drum in the carriage. The carriage includes a rotatably mounted drum containing three sections on which are wound the main and slackpulling lines, and a drop line which is utilized in raising and dropping the logs. The band brake assembly includes a unique crank and lever system for actuating the brake band, whereby the brake band tightly grips the brake drum surface of the brake assembly, thus to prevent drum rotation, with the slackpulling line loose. The brake assembly is controllably released with tensing of the slackpulling line, differing degrees of tensing producing differing degrees of release of the brake assembly.

6 Claims, 4 Drawing Figures

LOGGING CARRIAGE WITH BAND BRAKE

BACKGROUND AND SUMMARY OF THE INVENTION

This invention relates to a logging carriage, and more particularly to a novel carriage which includes a rotatably mounted drum carrying windings of multiple lines, and a band brake assembly for the drum normally braking rotation of the drum but releasable by applying tension to one of the lines wound on the drum.

A known form of log-hauling system includes a yarder with at least four power-operated drums thereon which have four lines wound about respective drums, commonly referred to as main, slackpulling, sky, and haulback lines. The sky line is stretched between the yarder and a stationary anchor situated remote from the yarder, and provides a track along which a log-hauling carriage can be shifted. Rotatably mounted on the carriage is a drum containing at least three sections, on which are wound the main and slackpulling lines, and also a drop line which is utilized in raising and dropping logs. The main and slackpulling lines are wound and counterwound in opposite directions on the drum. Paying out and taking in of these two lines produces drum rotation which is relied upon to raise or lower the drop line.

In the log-hauling system described, the weight of a log carried on the drop line produces a torque on the drum which is in the carriage, tending to unwind the drop line. To prevent such unwinding, tension is applied to the main line, which produces a countertorque on the drum, and to the haulback line, to counterbalance the tension in the main line and to prevent carriage shifting toward the yarder. This requirement that the main and haulback lines be under tension when a load is placed on the drop line causes substantial line wear, brake wear, and fuel consumption. Furthermore, the system described does not provide optimum control over movement of the drop line. It is difficult, for instance, gradually to lower the drop line under circumstances requiring precise deposit of the log load on some supporting structure.

A general object of this invention is to provide an improved log-hauling carriage which features a band brake assembly for controlling rotation of a drum in the carriage. With the organization contemplated, a drop line may be controllably lowered through controlled actuation of the band brake assembly. The band brake assembly may be actuated to stop rotation of the drum in the carriage during transport of logs along the sky line, reducing tension requirements in the mainand haulback lines.

Another object is to provide an improved log-hauling carriage of the above general description wherein the band brake assembly in the carriage is actuated to brake rotation of the drum with the slackpulling line loose, and actuated to release the drum with tensing of the slackpulling line.

Yet another object is to provide a log-hauling carriage with a band brake assembly as described, which includes a unique crank and lever system for actuating the brake band in the brake assembly, whereby the brake band tightly grips the brake drum surface of the brake assembly, thus to prevent drum rotation, with the slackpulling line loose. The brake assembly is controllably released with tensing of the slackpulling line, differing degrees of tensing producing differing degrees of release of the brake assembly.

A further object of the invention is to provide such a log-hauling carriage where the brake assembly normally, and with the slackpulling line loose, is held securely in a state preventing rotation of the drum in the carriage by an extensible device operated by stored gas under pressure.

These and other objects and advantages are attained by the invention, which is described hereinbelow in conjunction with the accompanying drawings and the following detailed description of a preferred embodiment.

DETAILED DESCRIPTION OF A PREFERRED EMBODIMENT OF THE INVENTION

Figure 1:
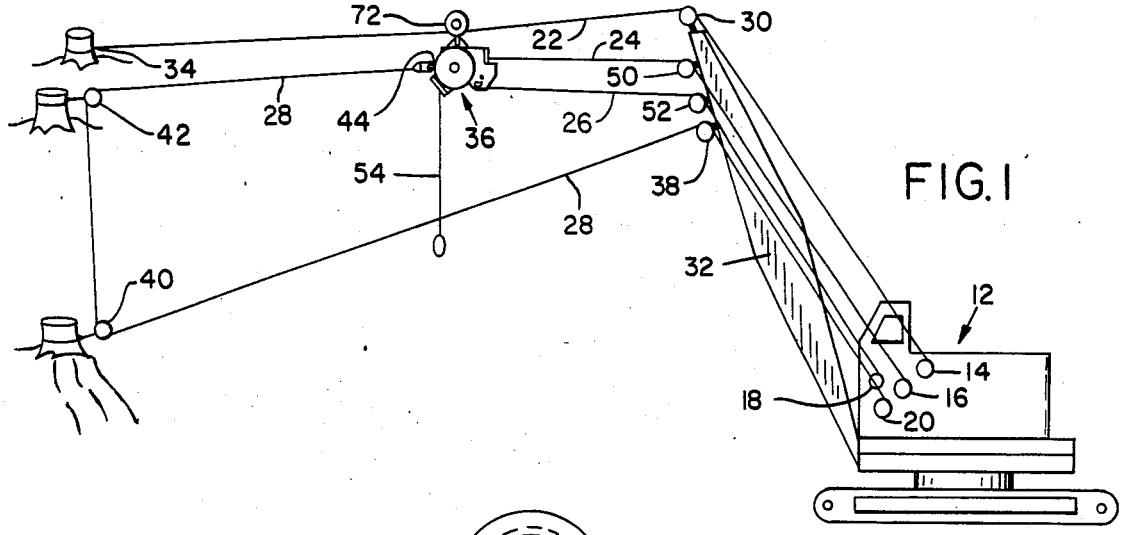
FIG. 1 is a simplified diagramatic view of a log-hauling system operated with a four drum yarder and equipped with a carriage as contemplated by the instant invention.

Referring now to the drawings, and more particularly to FIG. 1, illustrated very simply at 12 is a yarder. The yarder includes at least four drums which, through suitable controls in the yarder, may be braked, or rotated in either of opposite directions under power. These drums, indicated at 14, 16, 18, and 20 carry windings of line. More specifically, in the case of drum 14, such is a sky line 22. In the case of drum 16, such is a main line 24. In the case of drum 18, such is a slackpulling line 26. In the case of drum 20, such is a haulback line 28.

Sky line 22 extends from drum 14 over a pulley 30 mounted on a tower 32 in the yarder, to an end 34 which is anchored at a point remote from the yarder. Such is stretched tightly between its anchor and drum 14, and provides a track for a carriage 36 which is shiftable along the sky line between anchor 34 and pulley 30.

Haulback line 28 extends from drum 20 over a pulley 38 and then surrounds a pair of remote, anchored pulleys, shown at 40 and 42. The end of the haulback line is secured to the carriage at 44.

Main line 24 extends over pulley 50 on the yarder tower and thence to windings on a drum in the carriage, as will later be described. Similarly, slackpulling line 26 extends over pulley 52 on the tower to windings on the drum in the carriage. Also contained in windings on the drum in the carriage is a drop line 54 shown extending down from the carriage.

Figure 2:
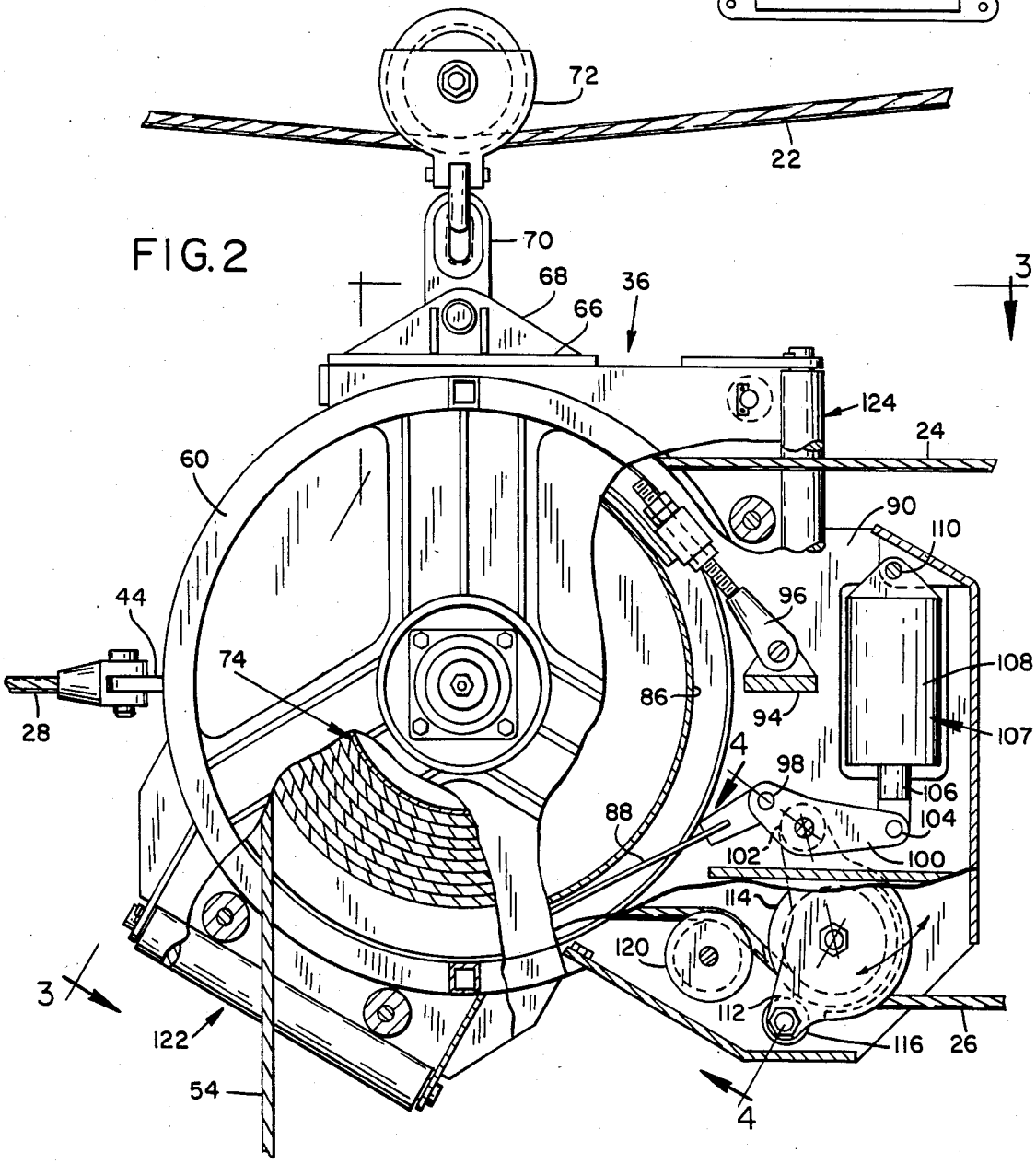
FIG. 2 is a side elevation of the carriage shown in FIG. 1, on a somewhat larger scale, and with portions broken away.
Figure 3:
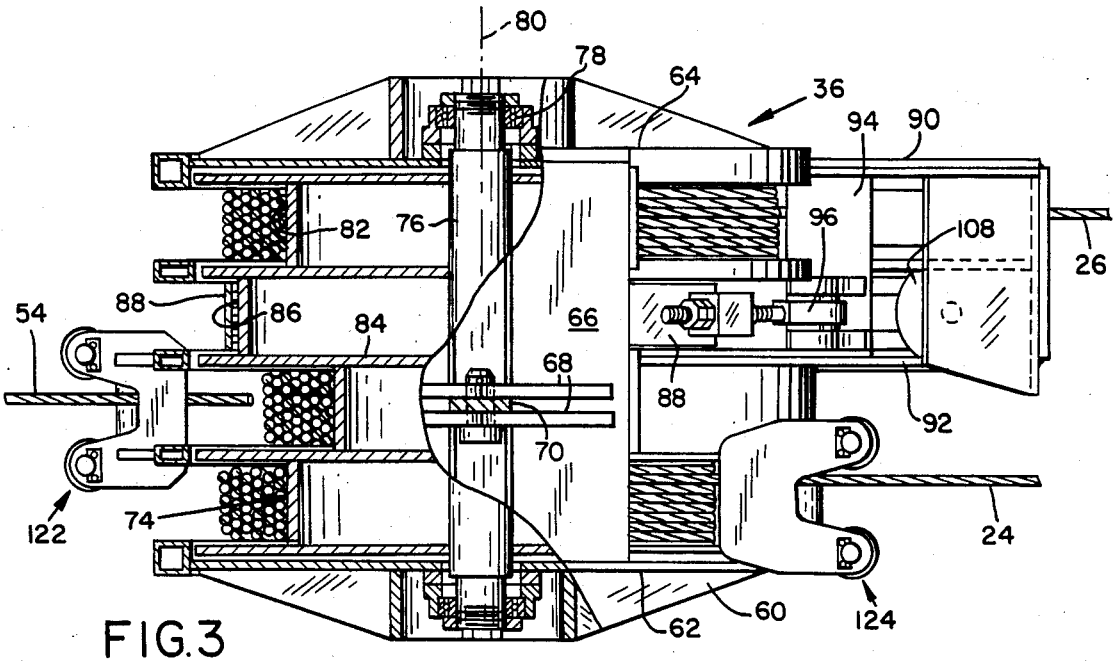
FIG. 3 is a view taken along the line 3—3 in FIG. 2.
Figure 4:
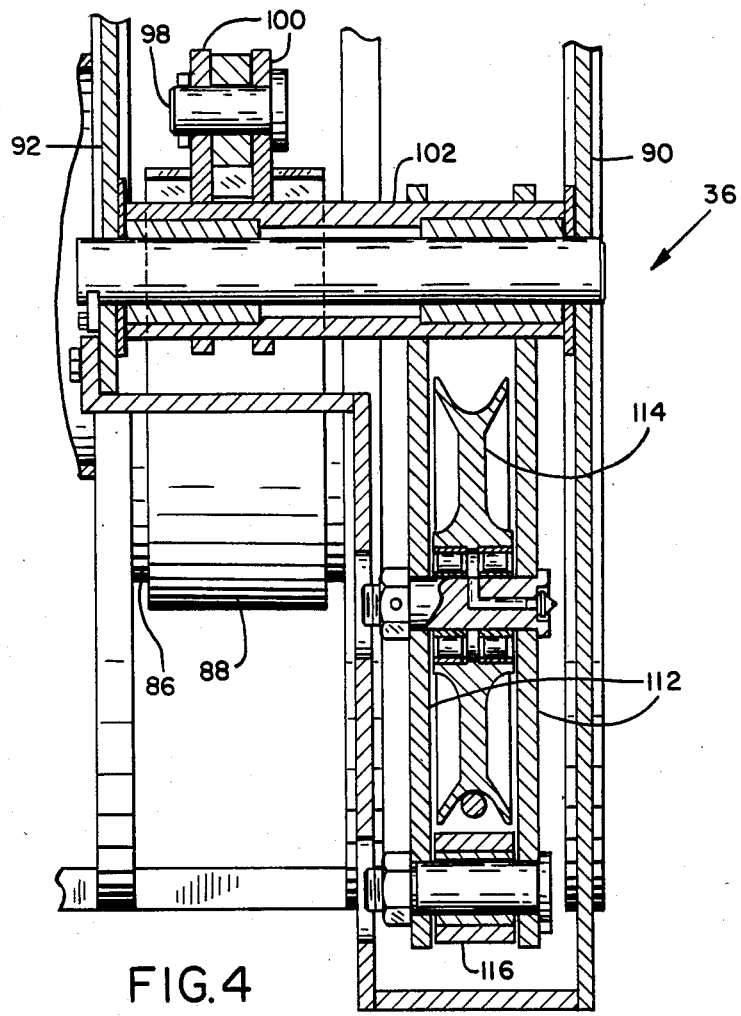
FIG. 4 is an enlarged, cross-sectional view, taken generally along the line 4—4 in FIG. 2.

Referring now to FIGS. 2 through 4, carriage 36 includes a housing 60 formed of opposed side plates 62, 64 securely joined together by structure including cross-member 66. Joined to this cross-member intermediate the side plates is a pair of brackets 68 pivotally mounting the base of a link 70 which is interconnected through an eye at the top of link with pulley structure 72.

The pulley therein rides on sky line 22 and thus the carriage tracks on the sky line when moving over the ground.

Rotatably mounted within the carriage housing is a carriage drum generally shown at 74. Such includes a drum shaft 76 journaled in the side plates, as by bearing assembly 78, and providing a rotation axis for the drum indicated, at 80. Suitably joined to the drum shaft are drum sections such as the one shown in 82 which provide support for windings of different lines on the drum. Separating the drum sections from each other are annular flange plates 84.

Explaining more fully the windings of the line on the drum, as viewed in FIG. 2 main line 24 extends tangentially into the drum and then extends in counterclockwise windings inwardly on the drum. Drop line 54 extends tangentially into the drum and then extends in clockwise windings. Slackpulling line 26 is wound in the opposite direction to the main line, i.e., extends tangentially into the drum and then extends in a clockwise direction as viewed in FIG. 2.

Shifting of the carriage back and forth along the sky line is under the control of lines 24, 26, and 28. More specifically, to move the carriage from right to left in FIG. 1 (or away from the yarder), haulback line 28 is taken in at a desired rate, and simultaneously the main line and slackpulling lines are paid out at the same rate. Return movement of the carriage results with simultaneous equal rate taking in of lines 24, 26 and paying out of line 28. It will be noted that during such carriage movement, and with the lines or line being paid out at the same rate as the line or lines being taken in, carriage drum 74 will not rotate. The drop line is lowered and raised by rotating and counter-rotating the carriage drum. To lower the drop line, main line 24 is paid out and slackpulling line 26 taken in. Conversely, raising of the drop line occurs with taking in of the main line and paying out of the slack pulling line.

Also part of the carriage drum is a cylindrical brake drum surface shown at 86 which is suitably joined to rotate with drum shaft 76. Extending about this brake drum surface is a brake band 88. The brake band and brake drum surface collectively makes up a band brake assembly in the carriage. Such brake assembly, in a direction extending axially on the drum, is directly adjacent the drum section containing the slackpulling line. This is dictated since tensing of the slackpulling line is relied upon to release the brake assembly and juxtapositioning of the brake assembly and section containing the slackpulling line promotes achieving this type of control.

More specifically, housing plate extensions 90, 92 are provided adjacent one end of housing 60. Located between these extensions and suitably secured in place is a brake anchor bar 94. Mounted on this anchor bar through a link 96 is one end of brake band 88, such constituting an anchored end in the brake band. The brake band extends around brake drum surface 86 to an actuating end which is pivotally joined at 98 to the adjacent set of ends of a pair of matching opposed levers 100.

Levers 100 are suitably joined intermediate their ends to an end of a tubular crankshaft 102. The crankshaft is ( rotatably mounted in place with such extending parallel to the axis of drum shaft 76 between housing plate extension 90, 92.

Levers 100 have a set of ends opposite the ends connected to the brake band which are pivotally connected, at 104, to a rod 106 of a position-cylinder device 107. Rod 106 extends downwardly from a piston disposed within a closed cylinder 108 containing a stored supply of gas under pressure. Compressed air has been found to be entirely suitable for the gas, and typically may be contained in the cylinder at a pressure ranging from 70 to 85 pounds per square inch. The upper end of the cylinder is pivotally mounted on the housing at 110. The gas under pressure within the cylinder operates yieldably to urge rod 106 downwardly in FIG. 2, to cause clockwise rotation of opposed levers 100 as there pictured, and consequent tightening of the brake band about the brake drum surface. The leverage provided by levers 100 provides a tightening force on the brake band sufficient to hold the carriage drum in a non-rotating state in the housing during all normal uses of the carriage.

The crankshaft extends parallel to the axis of the drum to an end which is disposed laterally out of the section in the drum holding the windings of slackpulling line 26. Here the shaft is joined to a set of ends of crank arm members 112. Journaled between these crank arm members is a rotatable pulley 114. A retainer roll 116 is rotatably mounted between these crank arm members with such extending across the edge of the pulley 114 adjacent its lower periphery.

Shown at 120 is a guide pulley which is rotatably mounted in a position between the housing plate extensions, in a region located to the left of pulley 114 in FIG. 2. As shown in FIG. 2, the slackpulling line extends from its windings on the drum over pulley 120 and thence around pulley 114 (to be held against this pulley by roller 116). On leaving the carriage it extends back to the yarder. It should be apparent from this discussion that with slack in the slackpulling line, i.e. with the line loose, extension of rod 106 under the action of the compressed air urges paired levers 100 in a clockwise direction in FIG. 2 causing tightening of the brake band about the brake drum surface. This tightening can be controllably loosened by applying various degrees of tension to the slackpulling line. With tension applied to the slackpulling line, this tends to shift pulley 114 upwardly and to the right in FIG. 2, causing clockwise rotation of the crankshaft and a loosening of the brake band. The degree of loosening is related to the amount that the crankshaft is rotated.

Shown at 122 is a fairlead roller assembly, serving to guide the drop line where such extends downwardly from the carriage. Shown at 124 is a similar fairlead roller assembly, serving to guide the main line where such extends from the drum of the carriage back to the yarder.

Explaining how the apparatus of the invention may be utilized in transporting logs, the carriage may be moved along the sky line to a region over where a log is to be picked up, and it will be assumed that this is to the left in FIG. 1 or away from the yarder. This is done with paying out of the main line, pulling in of the haulback line, and with sufficient paying out of the slackpulling line to maintain such loose. The drop line is then lowered by taking in the slackpulling line with tension being produced in the line. This causes forced rotation of the drum, causing the drop line to extend from the carriage. The main line is paid out at a rate corresponding to the rate at which the slackpulling line is taken in. With the log suitably attached to the drop line, the main line is taken in and slackpulling line paid out, but with tension remaining therein, causing the drop line to be wrapped up on the drum of the carriage. With the load raised, the slackpulling line is loosened which results in the brake assembly being actuated to cause braking of the drum. So long as relaxation is maintained in the slackpulling line, the drum in the carriage remains braked against rotation, and there is no danger of the drop line paying out accidently with loosing of the load.

With the load raised, and with movement of the carriage toward the log landing, the slackpulling line is maintained slack, with the brake assembly activated. The turn of logs is held at the desired height by the brake assembly. It is not necessary to maintain the haulback line under high tension to maintain the log load in a raised position. This results in reduced fuel consumption and reduced wear in the lines and yarder parts.

With the carriage over the landing area, to lower the load the slackpulling line is tensed and the main line is paid out. The slackpulling line is controllably tensed, to effectuate the degree of release of the brake assembly desired. Controlled lowering of the log load results.

While a particular modification of the invention has been described, it is obvious that changes and variations are possible without departing from the invention.

It is claimed and desired to secure by Letters Patent:

1. In a logging carriage which includes means for movably supporting said carriage on a skyline and a rotatable drum having a pair of lines with one of said pair wound in one direction and the other of said pair wound in the opposite direction in different sections of the drum, and a drop line on another section of the drum wound in the direction of one of said pair of lines, said pair of lines being operatively connected to means for actuating said lines, the improvement comprising a cylindrical brake drum surface forming another section of the drum, a brake band extending about said brake drum surface having an anchored and an actuating end, biasing means operatively connected to said actuating end of the brake band yieldably urging the actuating end in a direction causing tightening of the band about the drum, a pulley training said one of said pair of lines where such extends from said drum, and pivoted means mounting the pulley operatively connected to said actuating end of the brake band, said pivoted means pivoting on tensing of said one of said pair of lines and on pivoting operating to loosen the band about said drum.

2. The logging carriage of claim 1, wherein said other section of the drum is located, in a direction extending axially of the drum, adjacent said brake drum surface, and said pivoted means comprises a crank assembly including an arm joined to a shaft, said arm mounting said pulley with said pulley occupying the plane of said other drum section, and said shaft extending parallel to the axis of said drum to a connection with said actuating end of the brake band.

3. The carriage of claim 1, wherein said biasing means comprises a stored gas, gas-pressure-operated piston-cylinder device.

4. The carriage of claim 1, wherein said biasing means comprises a stored gas, gas-pressure-operated piston-cylinder device, and includes an extensible rod, and said rod is connected to said actuating end of said brake band through a pivoted lever.

5. The carriage of claim 4, wherein said pivoted means mounting the pulley and operatively connected to said actuating end of the brake band comprises a crank assembly including an arm joined to a shaft, said arm mounting said pulley with the pulley occupying the plane of said other drum section, and said shaft extending parallel to the axis of said drum to a point disposed radially outwardly of said brake drum surface, and said pivoted lever is joined to said shaft so as to pivot with rotation of the shaft.

6. In a logging carriage having means for movably supporting the carriage on a skyline which includes a rotatable drum, said drum including one section having a line wound thereabout, and a second section having a drop line wound thereabout wound in the same direction as to said firstmentioned line, said lines being operatively connected to means for actuating same, the improvement comprising, a cylindrical brake drum surface forming a third section of the drum, a brake band extending about said brake drum surface, brake band having an actuating end which is shifted tangentially of the drum surface to tighten the band about the brake drum surface, a cylinder spaced outwardly from the brake drum surface containing a stored gas supply under pressure and further including a rod projecting therefrom yieldably urged to extend from the cylinder by the stored pressurized gas supply, a crankshaft extending parallel to the axis of the drum having one end spaced outwardly from the brake drum surface and another end disposed outwardly of said one section of the drum, a lever joined intermediate its ends to said one end of the crankshaft, said lever having one end joined to the actuating end of the brake band and an opposite end joined to said rod, a crank arm joined to said outer end of said crankshaft and a pulley rotatably journaled on the crank arm disposed in the plane of said one drum section, said pulley training said first-mentioned line and tensing of said line operating to swing the crank arm and rotate the crankshaft in a direction causing loosening of the brake band where such extends about the brake drum surface.

* * * * *